US008130096B2

(12) United States Patent
Monte et al.

(10) Patent No.: US 8,130,096 B2
(45) Date of Patent: Mar. 6, 2012

(54) SIMPLEX PERSONAL AND ASSET TRACKER

(75) Inventors: Paul A. Monte, San Jose, CA (US); Michael Santiago, Pleasanton, CA (US); Robert D. Miller, Milpitas, CA (US)

(73) Assignee: Globalstar, Inc., Milpitas, CA (US)

( * ) Notice: Subject to any disclaimer, the term of this patent is extended or adjusted under 35 U.S.C. 154(b) by 254 days.

(21) Appl. No.: 12/657,470

(22) Filed: Jan. 20, 2010

(65) Prior Publication Data

US 2011/0177790 A1 Jul. 21, 2011

(51) Int. Cl.
*G08B 1/08* (2006.01)

(52) U.S. Cl. ..... 340/539.13; 340/539.11; 340/426.1; 340/988

(58) Field of Classification Search ..... 340/539.13, 340/988, 539.11, 426.1, 573.1, 573.4, 539.1, 340/539.16, 539.18, 429, 426.13, 426.19, 340/989, 991, 993; 455/404.2, 456.1, 457, 455/466, 41.2

See application file for complete search history.

(56) References Cited

U.S. PATENT DOCUMENTS 7,091,851 B2 * 8/2006 Mason et al. ..... 340/539.13
7,099,770 B2 8/2006 Naden et al.
7,337,061 B2 2/2008 Naden et al.
7,486,185 B2 * 2/2009 Culpepper et al. ..... 340/539.13
7,768,393 B2 * 8/2010 Nigam ..... 340/539.13
2010/0323715 A1 * 12/2010 Winters ..... 455/456.1

* cited by examiner

*Primary Examiner* — Anh V La
(74) *Attorney, Agent, or Firm* — Kenneth W. Float

(57) ABSTRACT

Disclosed are systems, apparatus and methods for tracking or locating an asset along with providing emergency and non-emergency messaging services. An asset tracker is disposed on an asset. The asset tracker has a motion sensor, a GPS receiver and a simplex satellite transmitter for communicating with a remote location (back office processing center). The asset tracker also has a short-range transceiver for communicating with a fob device carried by a user. If an authorized fob device is not in range of the asset tracker device and the asset tracker device moves, as determined by the motion sensor and/or GPS location data, GPS data are transmitted via a satellite to the back office. The office sends the information to a desired recipient (asset owner, law enforcement, etc.). The fob device communicates with the asset tracker device when it is in proximity thereof. The fob device is programmed to have depressible buttons that transmit emergency and non-emergency messages to the asset tracker device which communicates the GPS location and message via a satellite to the back office. The back office sends the information to a desired recipient. Messages processed at the processing center are sent as email messages to one or more designated email addresses, as a short message service (SMS) messages to one or more designated cell phones, or as messages to an asset recovery service or 911 emergency center.

17 Claims, 7 Drawing Sheets

Fig. 3
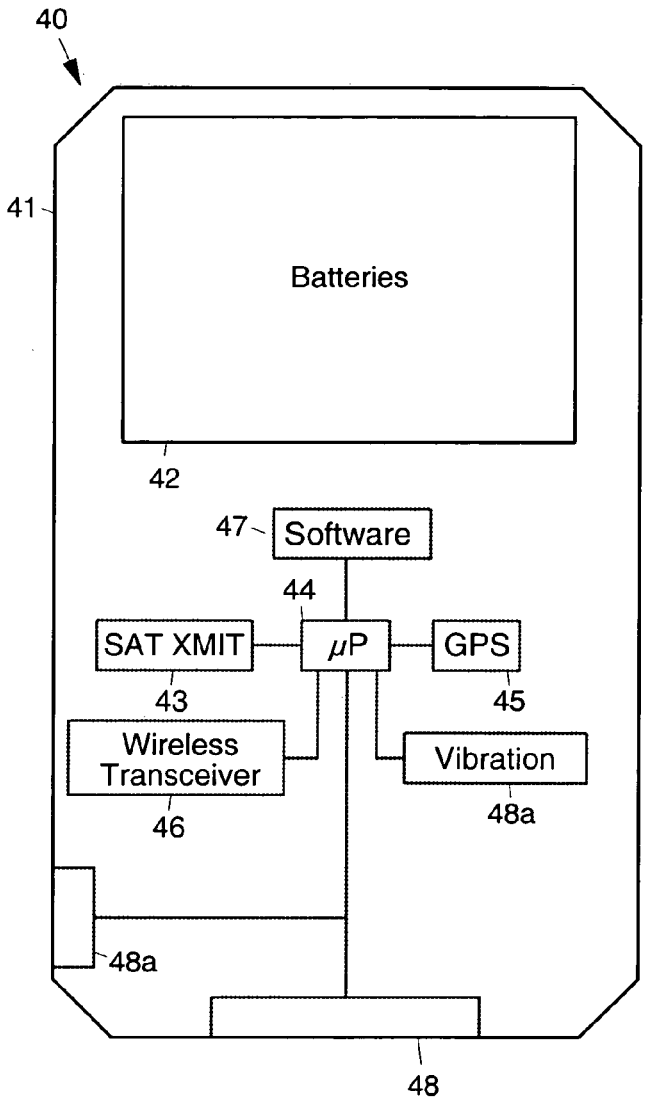
Fig. 3a
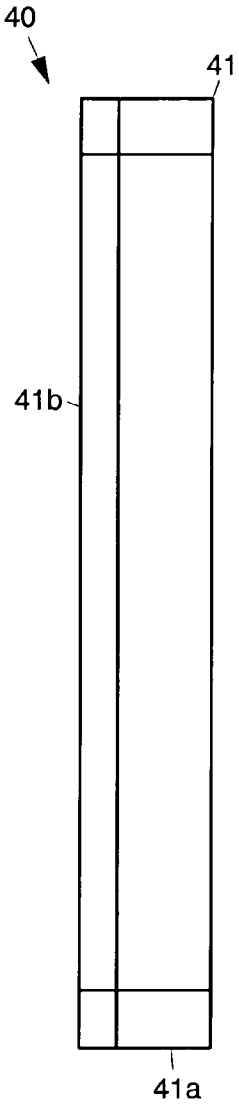
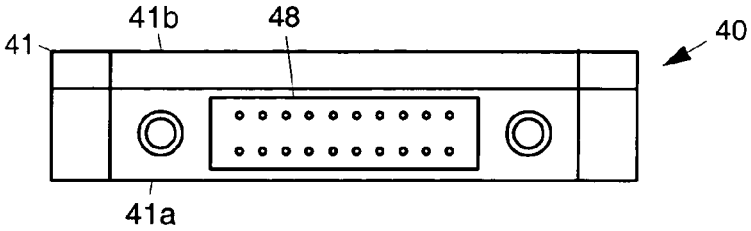
Fig. 3b

SIMPLEX PERSONAL AND ASSET TRACKER

BACKGROUND

The present invention relates to apparatus and methods for tracking and locating persons, sending messages, and locating assets.

Vehicle recovery companies include LoJack, ZoomBack, MicroTRAKgps, Mobile Gardian, Trimtrack, OnStar and ATX. The LoJack™ system, for example, provides discrete/covert ability and uses radio frequency communication. Dealers primarily install the LoJack system. Radio technology is inexpensive and the system is relatively easy to install. A tracking PC is used by law enforcement (federal, state, local) who use vehicles, helicopters, or aircraft to recover vehicles, which provides consumer confidence and acceptance. However, the LoJack system has no intranet tracking feature. The MicroTRAKgps system, for example, uses wireless GPS technology and satellite communication to provide for real time tracking. The MicroTRAKgps system is used by original equipment manufacturers including Jaguar, Land Rover and Volvo.

The LoJack asset recovery system is designed to assist in asset recovery. The LoJack system is most often employed with vehicles in which a tracking device is installed. The LoJack system uses cellular communication. The OnStar™ system in an in-vehicle system that may be used for asset recovery, emergency notifications and operator assistance. However, the LoJack and OnStar systems do not permit communication of messages to other individuals such as would provide for sharing of trip-related information, or transmission of messages indicating alerts (such as on/off or open/close alerts), and do not provide for worldwide coverage.

Facts relating to vehicle recovery are that US yearly vehicle thefts are greater than 1 million, which is 1 out of every 190 cars, one about every 26 seconds. The North American theft rate is higher than the rest of the world. Vehicle theft is highest in urban cities. The western US has the highest theft rates in North America (6 out of the top 10 locations). Carjacking is less than 3% of vehicle thefts in North America. A majority of people polled in North America want a vehicle theft recovery devices. By 2010, it is expected that automakers will offer vehicle recovery packages via their dealers.

U.S. Pat. Nos. 7,099,770 and 7,337,061 disclose devices and applications that use cellular communication to provide location information. U.S. Pat. Nos. 7,099,770 and 7,337,061 each disclose, as evidenced by their titles, a "Location monitoring and transmitting device, method, and computer program product using a simplex satellite transmitter." The respective Abstracts indicate that the patents disclose a "device, method, and computer program product for monitoring and transmitting a location and a local status of a remote device using a simplex satellite transmitter. The monitoring device includes a position location unit, a simplex satellite transmitter, a power source, and a controller. The position location unit is configured to determine a location of the remote device. The simplex satellite transmitter is configured to transmit the location to one or more satellites in low earth orbit. The controller includes a power management unit configured to control a power state of the position location unit and the simplex satellite transmitter, and to periodically enable and disable power from the power source to the position location unit and the simplex satellite transmitter."

Thus, U.S. Pat. Nos. 7,099,770 and 7,337,061 each disclose an single-unit monitoring device which is programmed to determine and transmit its location via a low earth orbiting satellite. There is no disclosure in U.S. Pat. No. 7,099,770 or U.S. Pat. No. 7,337,061 regarding the use of a separate hand-held user-controlled device that communicates with an asset tracking device, which in turn communicates messages from either the hand-held user-controlled device or the asset tracking device via satellite a low earth orbiting satellite.

The assignee of the present invention has previously developed a "SPOT™" tracker that is disclosed in U.S. patent application Ser. No. 12/215,462, filed Jun. 27, 2008. The SPOT tracker is a hand-held user-carried device that embodies a satellite transmitter, amplifier and antenna, and that is carried by a user to allow emergency message communication via satellite to emergency personnel or other remotely-located persons. However, the SPOT tracker cannot be readily used to track assets, such as vehicles or ship containers, for example, unless the user is collocated with the assets. The SPOT tracker is embodied in a single hand-held user controlled device that communicates via a low earth orbiting satellite. The SPOT tracker does not communicate via a secondary device that transmits messages via a low earth orbiting satellite.

It would therefore be desirable to have apparatus and methods that implement personal and asset tracking, and that track and locate persons, send messages, and locate assets. It would also be desirable to have apparatus and methods that permit message communication to non-emergency individuals, sharing of trip-related information, or transmission of alert messages.

BRIEF DESCRIPTION OF THE DRAWINGS

The various features, functionalities and practical advantages of the present invention may be more readily understood with reference to the following detailed description taken in conjunction with the accompanying drawings, wherein like reference numerals designate like structural elements, and in which:

FIGS. 3, 3*a* and 3*b* illustrates an exemplary asset tracker device that is collocated with an asset that is to be tracked or monitored;

DETAILED DESCRIPTION

Figure 1:
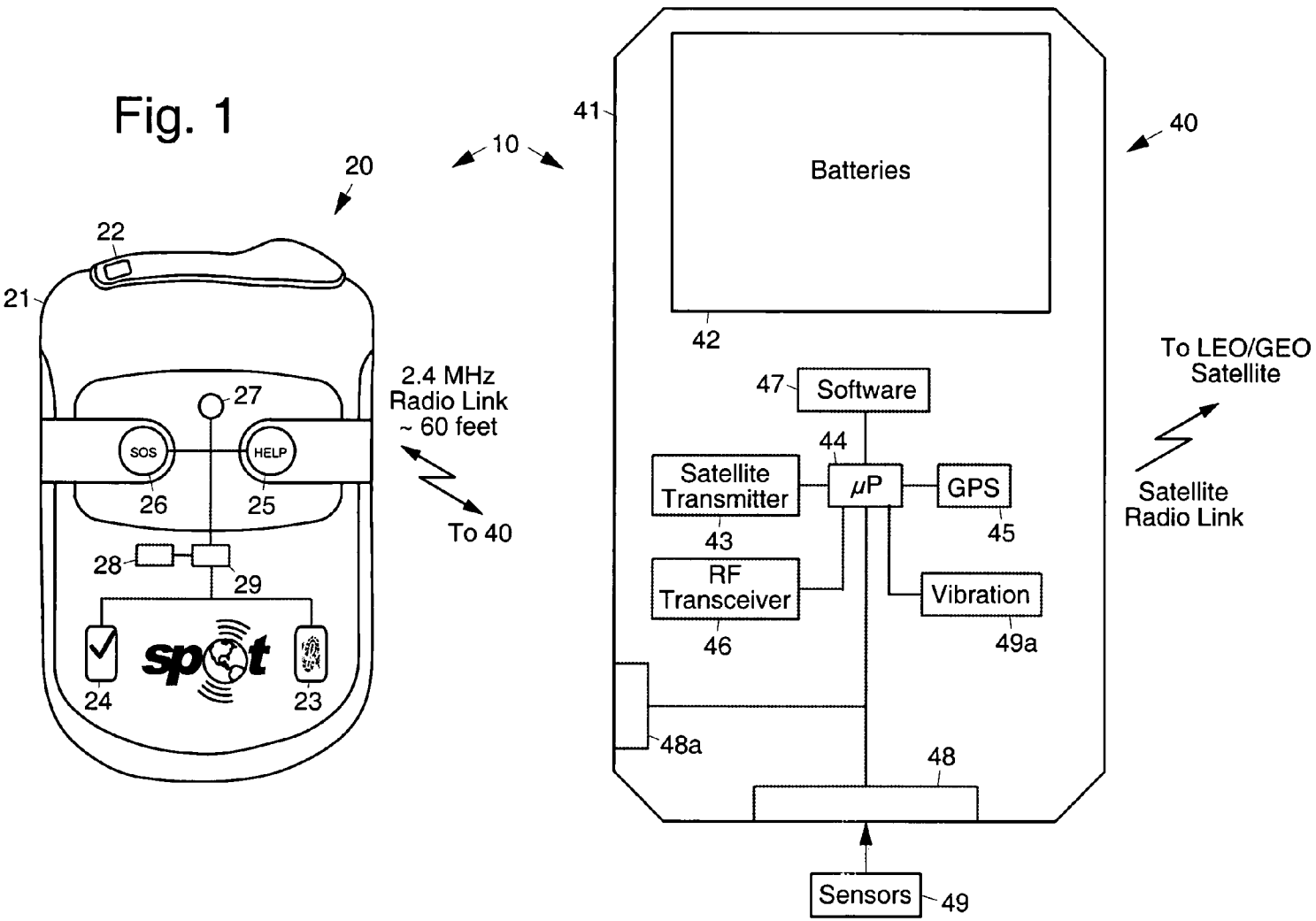
FIG. 1 illustrates an exemplary simplex personal and asset tracker.

Disclosed are apparatus and methods for tracking and locating persons, sending messages, and locating assets. An exemplary embodiment comprises a small user-carried device, or fob, that embodies some or all of the functionality of a SPOT™ tracker disclosed in U.S. patent application Ser. No. 12/215,462, filed Jun. 27, 2008, assigned to the assignee of the present invention, but does not contain a satellite transmitter, amplifier or antenna. The contents of U.S. patent application Ser. No. 12/215,462 are incorporated herein by reference in its entirety. The fob is made relatively small, and may have the size of a car key fob, for example.

The fob wirelessly communicates over a relatively short range with an asset tracking device, or asset tracker, that is attached to an asset, such as a vehicle (car, truck, motorcycle, boat) or ship container, for example. Each fob has a unique ID that the asset tracker uses to identify an authorized user. The asset tracker may be programmed to recognize multiple fobs (IDs), and multiple fobs may be paired with multiple asset trackers, so that multiple users of multiple vehicles, for example, can interface with multiple asset trackers.

The asset tracker has a short-range wireless communication interface for communicating with the fob(s), and a satellite communication interface for transmitting simplex (one-way) messages by way of a satellite to a remote location (network). Alerts regarding asset movement and I/O activity along with messages transmitted from the fob(s) by way of the asset tracker that are received at the remote location (network) are forwarded to a customer who owns or is responsible for the asset or is to receive messages from the user carrying the fob. In addition, the asset tracker may be configured to have a terrestrial wireless network interface, such as cellular interface, to allow communication with the remote location (network) if satellite communication is unavailable.

The user carrying the fob thus has personal tracking functions in a small device as long as the fob is in range of the asset tracker. Alerts and messages transmitted from the fob are relayed by the asset tracker over the satellite link to the network and ultimately to the desired contact. Alerts include emergency messages and tracking messages, for example. If the fob is not in range of the asset tracker, and the asset is moving, the asset tracker can sense this, and it transmits its location to the network and desired contact along with an "unauthorized movement" message that indicates that it could be stolen.

Each fob may be configured to have user-specific functions depending upon the asset to which the asset tracker is attached. Thus, alerts may be transmitted by the asset tracker if the asset travels at an unauthorized speed or to an unauthorized location, for example (i.e., geo-fence). Each alert may include transmit time, location, and fob ID, for example.

The asset tracker is configured to transmit GPS location data to the network if it is in motion and an authorized fob is not substantially collocated with it. Software at the remote location may be configured to process the GPS location data to determine speed and direction of motion of the asset or determine if there is rapid deceleration, indicating a possible accident, or such determinations can be made locally at the asset tracker. Results of this determination may be transmitted to appropriate authorities or to the designated customer.

The asset tracker may be utilized in fixed locations, such as on a race track or at specific locations in a building, for example. When a fob passes by the asset tracker, the fob ID is identified by the asset tracker and reported to the remote site to indicate presence of the fob at that location. This insures that the person or vehicle with the fob has reached a particular location, such as a location along a race track, or a guard passing by a check point in the building. In addition, sensors may be attached to the asset tracker to monitor opening of doors or windows of a vehicle or building, for example.

The asset tracker may be used in other security applications. For example, asset trackers may be placed at strategic locations on a campus, with each student carrying a uniquely-identified fob. Student locations may be identified and tracked as fobs pass by each of the asset tracker locations. The fobs would allow the SPOT personal tracking functions to be used by students, including transmission of 911 emergency and help messages to relevant campus emergency service personnel.

Thus, the disclosed apparatus (SpotOn™) and methods provide for an asset tracking GPS device (asset tracker) and a key fob that wirelessly communicates with the asset tracking device. The asset tracking device is mounted to an asset (car, boat, other vehicle or equipment). Alert and tracking information is sent from the asset tracker to a remote network via simplex communication using a satellite. Alerts of asset movement and I/O activity are then sent to the customer. The key fob remote includes many Spot™ features to allow a person within wireless range of the tracking device to press a button and send a request for help, for example.

Figure 2:
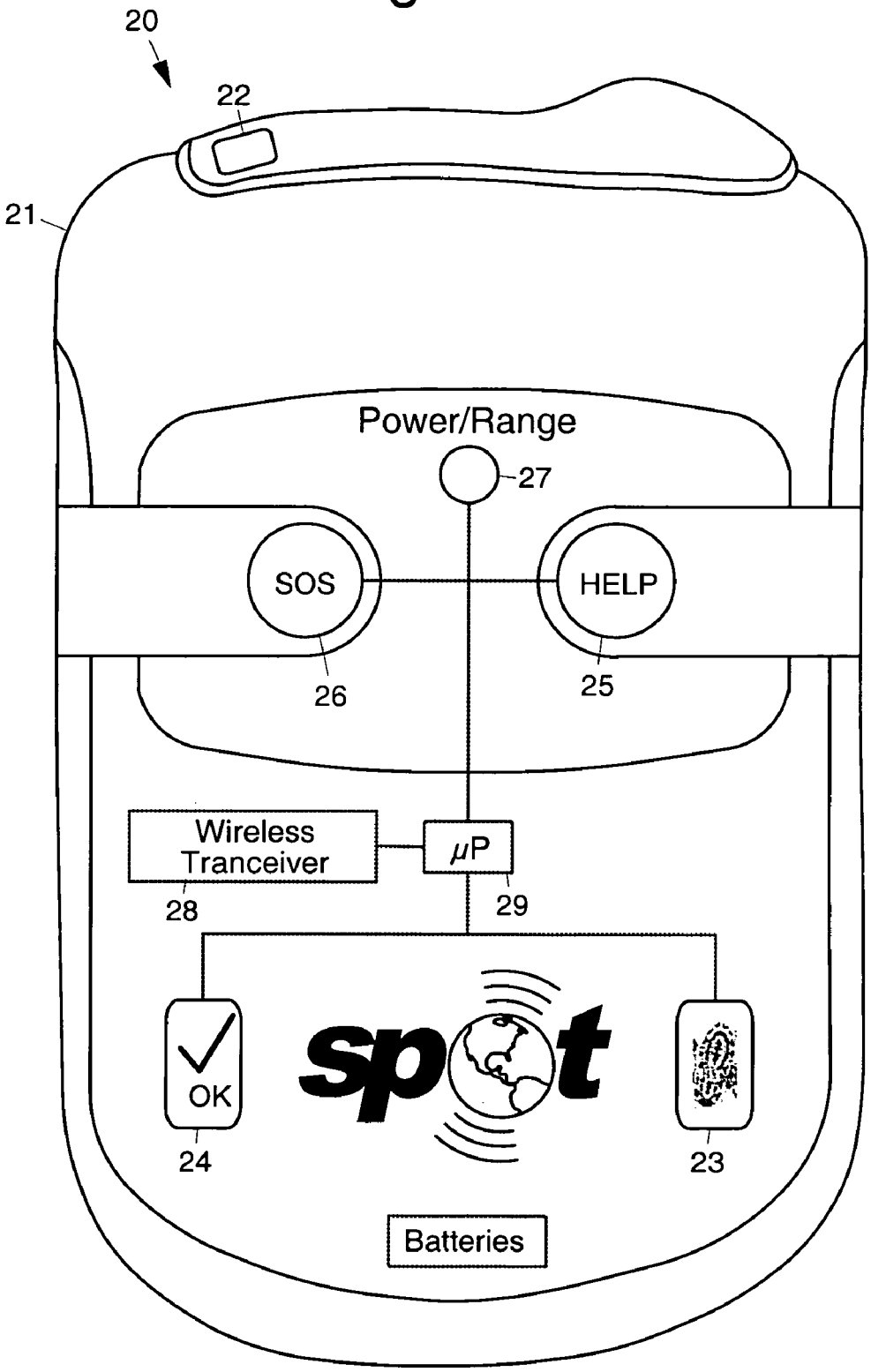
FIG. 2 illustrates an exemplary fob device that is carried by a user.

Referring now to the drawing figures, FIG. 1 illustrates an exemplary simplex personal and asset tracking apparatus 10. The exemplary apparatus 10 has two main components: a fob device 20 that is carried by a user, and an asset tracker device 40 that is collocated with an asset 11 (FIG. 6) that is to be tracked or monitored. FIG. 2 shows an enlarged view of an exemplary fob device 20.

The exemplary fob device 20 is a hand-held user-carried device having a housing 21 with an optional key ring loop attachment 22, a plurality of button-type or membrane-type depressible switches or buttons 23-26, and a multi-color power/range light emitting diode (LED) indicator 27. The multi-color power/range LED indicator 27 is used to indicate fob power and range of the fob 20 from the asset tracker device 40. Each of the buttons 23-26 are preferably backlit with a LED indicator.

Figure 4:
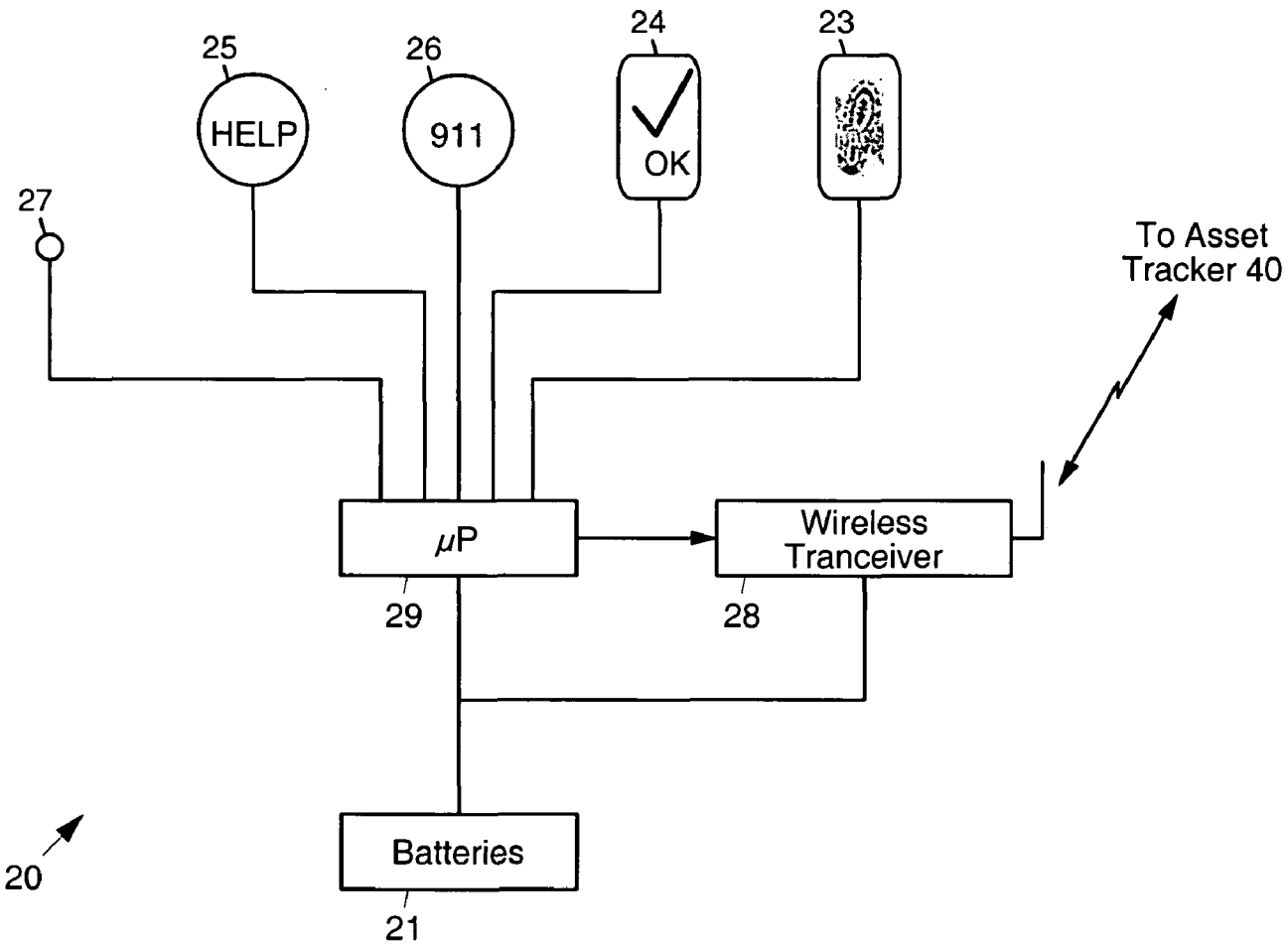
FIG. 4 illustrates an exemplary system employing the simplex personal and asset tracker.

Along with FIGS. 1 and 2, FIG. 4 illustrates the electronics contained in the fob device 40. Disposed inside the housing 21 of the fob device 20 are batteries, a short-range wireless transceiver 28 and a microprocessor (μP) 29. The short-range wireless transceiver 28 is coupled to the microprocessor 29, along with each of the buttons 23-26, their backlighting indicators, and the power/range LED indicator 27. The short-range wireless transceiver 28 is preferably a 2.4 MHz radio link having an approximate 60 foot transmission range. The short-range wireless transceiver 27 permits communication between the fob device 20 and the asset tracker device 40.

The depressible switches or buttons 23-26 preferably include a tracking button 23, a check/OK button 24, a help button 25, and an SOS (emergency) button 26. Selected buttons 23-26 may be used in combination to arm a geo-fence and to capture the geo-location of a point of interest, for example, when it is in range of the asset tracker device 40. The microprocessor 29 is programmed to send a wakeup signal to the asset tracker device 40 when it is in proximity of the asset tracker device 40 when the check/OK button 24 is depressed.

A green light emitting diode indicator 27 may indicate that power is adequate for operation, an orange light emitting diode indicator 27 may indicate that power is low, a red light emitting diode indicator 27 may indicate that power is unavailable, and a flashing green light emitting diode indicator 27 may indicate that the fob 20 is within range of the asset tracker device 40 so as to permit transmission of messages from the fob 20 via the asset tracker device 40.

The fob device 20 is configured to operate as a function of the programming of the microprocessor 29. The microprocessor 29 is programmed to implement various operating modes of the fob device 20, which respond to button presses. Operation of the fob device 20 and the different operating modes that the microprocessor 29 may be programmed to provide are discussed in more detail below. Such programming is generally routine for those skilled in microprocessor programming and specifics regarding the programming will not be discussed in detail herein.

The tracking button 23 a puts the asset tracker device 40 in "track mode" or cancels track mode. The check/OK button 24 sends an OK/Check mode message and performs an "in-range" check depending upon how long the check/OK button 24 is pressed. The Help button 25 sends a Help or Cancel Help mode message depending upon how long the button 25 is pressed. The SOS (911 Emergency) button 26 sends a 911 Emergency or Cancel 911 Emergency mode message depending upon how long the button 26 is pressed.

The fob device 20 may be programmed to function in a manner similar to the personal locator device disclosed in U.S. patent application Ser. No. 12/215,462. Details regarding such programming may be found in this patent application, and will not be discussed in detail herein.

FIG. 1 and FIGS. 3, 3*a* and 3*b* illustrate an exemplary asset tracker device 40 that is collocated with an asset 11 (FIG. 5) that is to be tracked or monitored. The asset tracker device 40 has a housing 41 that comprises a lower portion 41*a* and a waterproof cover 41*b*. The exemplary asset tracker device 40 comprises batteries 42, a satellite transmitter 43 for transmitting simplex (one-way) messages, a microprocessor 44 having software 47, a global positioning system (GPS) receiver 45 and a wireless short range radio frequency (RF) transceiver 46 for receiving signals transmitted by the short-range wireless transceiver 28 in the fob device 20. A connector 48 is accessible from outside of the housing 41 that allows connection of a variety of sensors 49, such as motion sensors, switches indicating door, or window opening, for example. In addition a vibration sensor 49*a* may be included in the asset tracker device 40 to independently sense motion of the asset tracker device 40. A USB connector 48*a* may be included for laptop programming of the microprocessor 44.

Figure 5:
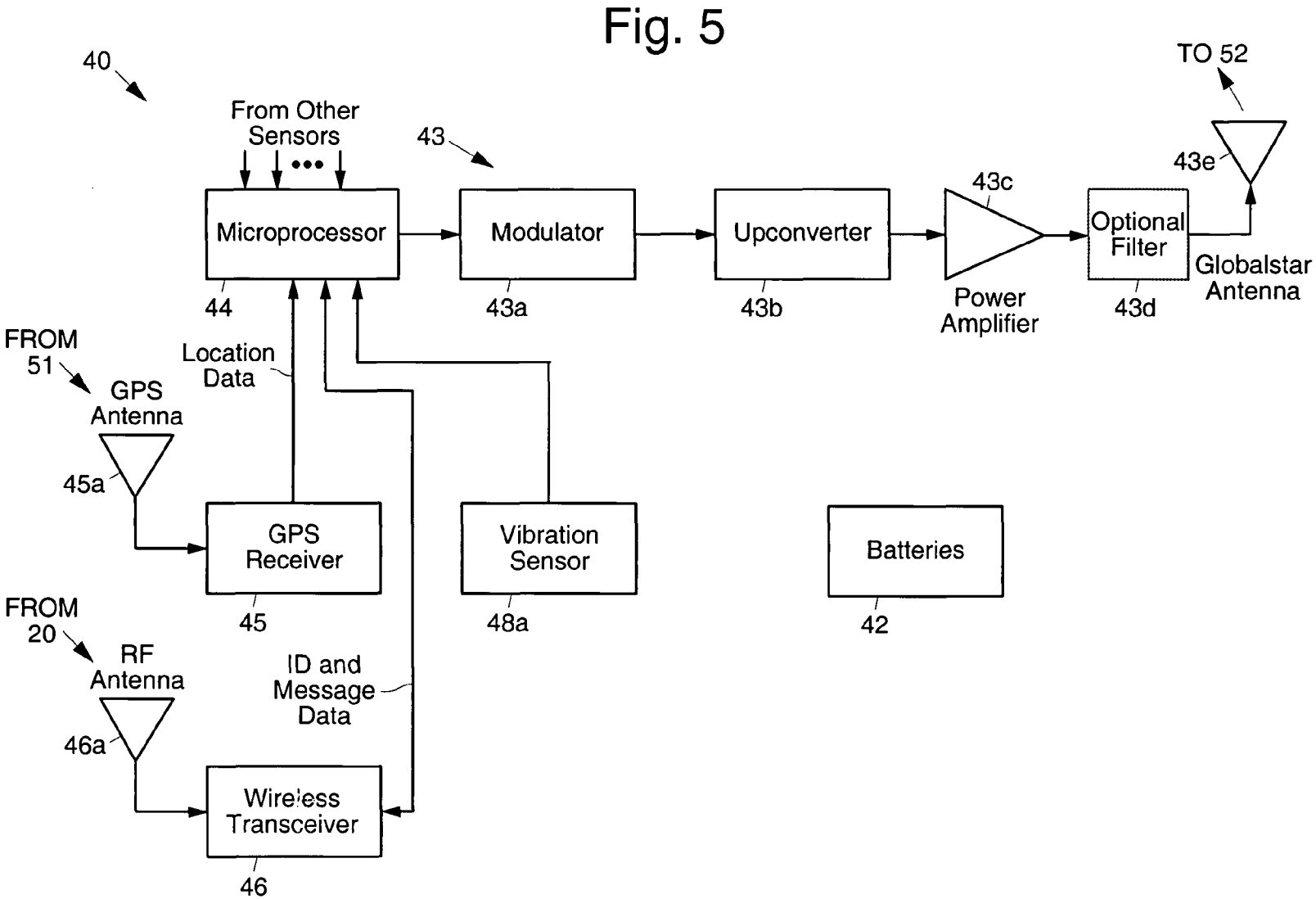
FIG. 5 illustrates details of the electronics employed in the simplex personal and asset tracker.

FIG. 5 shows details of the electronics contained in the exemplary asset tracker device 40. The GPS receiver 45 has an antenna 45*a* that receives signals transmitted by GPS satellites 51 (FIG. 5). The GPS receiver 45 operates in a conventional manner to receive and process GPS signals to generate location data. The wireless transceiver 46 has an antenna 46*a* that receives signals transmitted by the short-range wireless transceiver 28 in the fob device 20. The wireless transceiver 46 can also transmit messages to the transceiver 28 in the fob device 20. The GPS receiver 45 and wireless transceiver 46 are coupled to the microprocessor 44.

Figure 6:
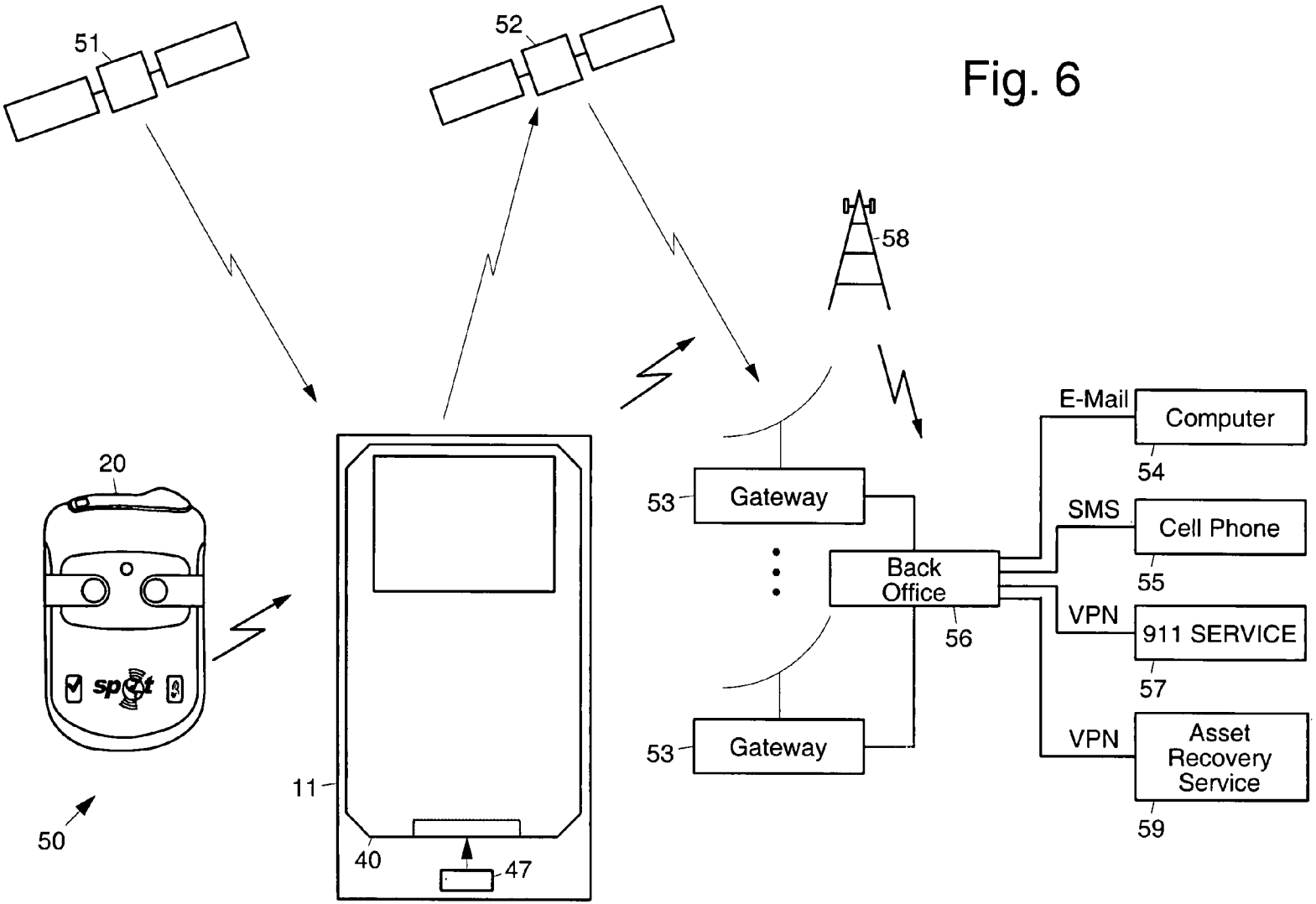
FIG. 6 illustrates components of an exemplary system employing the fob device and simplex personal and asset tracker device.

The microprocessor 44 is configured via software 47 to process signals derived from the GPS receiver 45 and wireless transceiver 46 and generate messages for transmission by way of the satellite transmitter 43 by way of a satellite 52 (FIG. 6) to a remote location (network) 56 FIG. 6). The communication satellite 52 may be one of a number of low earth orbiting (LEO) satellites, or a geosynchronous earth orbiting (GEO) satellite, for example, operated by the assignee of the present invention, for example. The satellite transmitter 43 has an output coupled to the microprocessor 44. The satellite transmitter 43 comprises a modulator 43*a*. an upconverter 43*b*, a power amplifier 43*c*, a filter 43*d* and a satellite antenna 43*e*.

The GPS receiver 45 is coupled to a GPS antenna 45*a* used to receive signals from the GPS satellites 51. Outputs signals from the GPS receiver 45 provide location data indicative of the location of the asset tracker device 40. The location data is input to the microprocessor 44.

The microprocessor 44 outputs signals that are coupled to a modulator 43*a*. The signal output of the modulator 43*a* is coupled to an upconverter 43*b* that upconverts the signal for transmission. The upconverted signal is coupled to an amplifier 43*c* that amplifies the upconverted signal for transmission. The amplified, upconverted signal is applied to a filter 43*d* and is coupled to an antenna 43*e* for transmission to the communication satellite 52.

FIG. 6 illustrates components of an exemplary system 50 employing the fob device 20 and simplex personal and asset tracker device 40. FIG. 6 illustrates components of an exemplary locating system 50 employing the fob device 20, asset tracker device 40, GPS satellites 51, one or more communication satellites 52, and the back office 56.

As is shown in FIG. 6, the asset tracker device 40 is disposed on the asset 11. The fob device 20 communicates with the asset tracker device 40 when it is in proximity of the asset tracker device 40 (~60 feet). The asset tracker device 40 GPS receiver 45 receives GPS signals from GPS satellites 51 and processes them to generate location data. The wireless transceiver 46 in the asset tracker device 40 receives signals transmitted by the short-range wireless transceiver 28 in the fob device 20. The satellite transmitter 43 transmits simplex messages comprising the ID and location of the asset tracker device 40 by way of the satellite 52 to the remote location 56. The remote location 56 may be what is referred to as a "back office" which is networked to satellite gateways 53 that communicate with the communication satellite 52. In addition, the back office 56 may receive signals transmitted by the asset tracker device 40 by way of a terrestrial wireless network 58, such as cellular network 58, in the event that satellite communication is unavailable. Software at the back office 56 processes received simplex messages and retransmits them to designated individuals or 911 emergency personnel. For example, the back office 56 is configured to forwards messages to user-designated email addresses (computers 54), short message service (SMS) messages to selected cell phones 55, and to an asset recovery service 59 or 911 emergency service 57 (emergency service provider 57).

The asset tracker device 40 receives GPS signals from the GPS satellites 51 and processes those signals to generate location data. In asset tracking mode, if the fob device 20 is not collocated with the asset tracker device 40, the location data, along with an operating mode signal indicative of the fact that the asset tracker device 40 are configured as a message and transmitted to the one or more communication satellite 32.

The location data, along with an operating mode signal indicative of the motion of the asset tracker device 40, are configured as a message and transmitted to the one or more communication satellite 32. The communication satellite 32 receives the message, translates the message to a different frequency, amplifies the message, and transmits the message to one or more gateways 33. The one or more gateways 33 receive and demodulate the message to produce a digital message, and send the digital message to the back office 56.

At the back office 56, the digital message is processed to determine the location of the asset tracker device 40 and determine, or process the unauthorized movement message transmitted by the asset tracker device 40 indicating that it is moving (and thus the asset 11 has been stolen) and sends it to destinations identified in list of email addresses and cell phone numbers and contacts law enforcement personnel.

If the user is collocated with the asset tracker device 40, and the user depresses one of the communication buttons 23-26 on the fob 20, the location data, along with an operating mode signal indicative of the status of the person using the fob device 20, are configured as a message and transmitted to the one or more communication satellite 32. The communication satellite 32 receives the message, translates the message to a different frequency, amplifies the message, and transmits the message to one or more gateways 33. The one or more gateways 33 receive and demodulate the message to produce a digital message (comprising the GPS location and button information), and send the digital message to the back office 56. At the back office 56, the digital message is processed to determine what to do with the message. If the message relates to an emergency, the back office 56 sends it via a virtual private network (VPN) to the emergency service provider 57 or to the asset recovery service 59; if it is an OK/Help, etc, the back office 56 sends it to destinations identified in list of email addresses and cell phone numbers. If the asset tracker device 40 is in track mode, location data is stored for later processing, or is output to generate a location on a map, for example.

The back office 56 generates an email message that is sent to one or more designated email addresses (computers 54), a short message service (SMS) message that is sent to one or more designated cell phones 55, or an SMS message that is sent to a 911 emergency center 57. Where the message is sent depends upon the situation (mode) that the user is in, i.e., whether the user is OK and is sending his or her location to loved ones or is letting recipient know that he or she has arrived at a destination, that he or she needs help, or that he or she is in a dire emergency situation.

Thus, if the asset 11 moves without the fob 20 then (motion sensor) alerts are generated by the asset tracker device 40, and tracking starts (theft mode). If the asset 11 moves with the fob 20 or the fob 20 is within proximity of the asset tracker device 40, then communication features (i.e., help, SOS) can be used (personal mode).

The primary purpose of the asset tracking apparatus 10 is asset recovery, including cars, motorcycles, boats, construction equipment (including bob cats, generators, boat engines, and the like). During asset tracking and recovery, the fob 20 is beyond the communication range of the wireless link between the fob device 20 and the asset tracker device 40. Preferably, movement of the asset 11 is verified using signals received from multiple GPS satellites 51. This is because of possible movement errors caused by waves, vibration resulting from passing vehicles or a passing train, for example.

Alerts and tracking information are sent to the back office 56 which manages the recovery process for customers. The back office 56 transmits location information to law enforcement personnel. The law enforcement personnel do not need homing beacon hardware such as is required by LoJack, for example. Alerts regarding asset movement are sent to customers via cell and email messages, although asset location data are not necessarily communicated to the customer.

I/O sensors 47 are used to connect to external switches such as a bilge pump of a boat, for example. Alerts regarding I/O activity are sent to customers. Alerts regarding I/O are user-settable in terms of duration or I/O activity before an alert is sent.

When the fob 20 is within range of the asset tracker device 40, message communication features are available to the user. Many of the Spot™ features described in U.S. patent application Ser. No. 12/215,462 may be included in the fob 20. The fob device 20 is always on and active, and may be configured so that the power indicator LED 27 blinks green when the asset tracker device 40 is in range, and blinks red when the battery in the fob device 20 is low.

A desired boundary (geo-fence) perimeter distance may be entered into the via physical connection to the asset tracker device 40 using software on a laptop. Latitude/longitude location is set/stored on location. The asset tracker device 40 is programmed to re-center itself at a new location. If the asset 11 is moved to a new job site, for example, a switch may be reset and asset tracker device 40 re-centers itself to that location, using the previously programmed perimeter distance. The boundary (geo-fence) perimeter is the delta longitude and latitude based on the initial GPS reading when the asset tracker device 40 it turned on.

Figure 7:
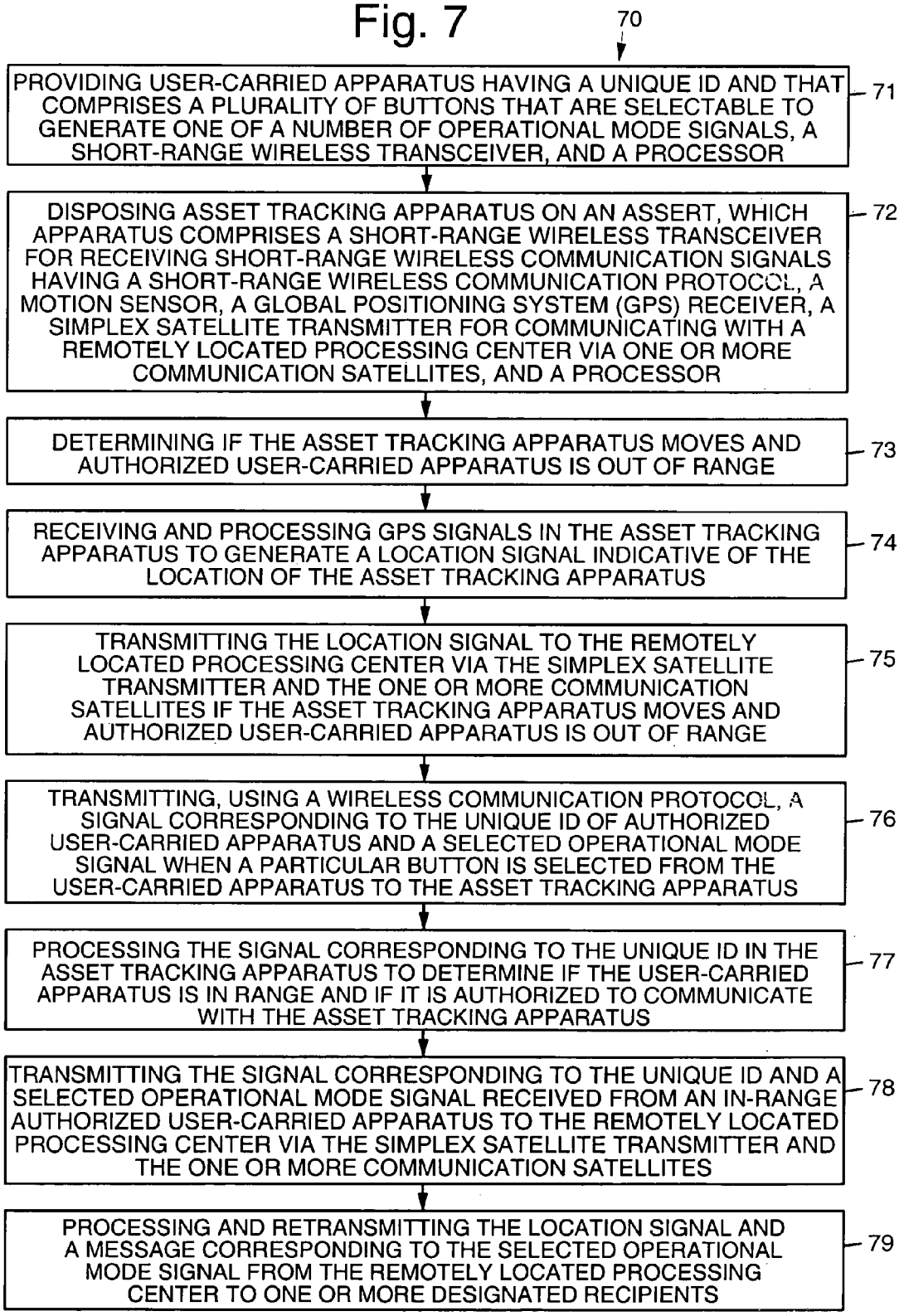
FIG. 7 is a flow diagram that illustrates an exemplary asset tracking method.

FIG. 7 is a flow diagram that illustrates an exemplary asset tracking method 70. The exemplary asset tracking method 70 is as follows.

User-carried apparatus is provided 71 that has a unique ID and that comprises a plurality of buttons that are each selectable to generate one of a predetermined number of operational mode signals, a short-range wireless transmitter, and a processor. Asset tracking apparatus is disposed 72 on an assert, which asset tracking apparatus comprises a short-range wireless receiver for receiving short-range wireless communication signals having a short-range wireless communication protocol, a global positioning system (GPS) receiver, a simplex satellite transmitter for communicating with a remotely located processing center via one or more communication satellites, and a processor.

It is determined 73 if the asset tracking apparatus moves and authorized user-carried apparatus is out of range. GPS signals are received and processed 74 in the asset tracking apparatus to generate a location signal indicative of the location of the asset tracking apparatus. The location signal is transmitted 75 to the remotely located processing center via the simplex satellite transmitter and the one or more communication satellites if the asset tracking apparatus moves and authorized user-carried apparatus is out of range.

A signal corresponding to the unique ID of authorized user-carried apparatus and a selected operational mode signal is transmitted 76 using a short-range wireless communication protocol when a particular button is selected from the user-carried apparatus to the asset tracking apparatus. The signal corresponding to the unique ID is processed 77 in the asset tracking apparatus to determine if the user-carried apparatus is in range and if the user-carried apparatus is authorized to communicate with the asset tracking apparatus.

The signal corresponding to the unique ID and a selected operational mode signal received from an in-range authorized user-carried apparatus are transmitted 78 to the remotely located processing center via the simplex satellite transmitter and the one or more communication satellites. The location signal of the asset tracking apparatus and a message corresponding to the selected operational mode signal are processed and retransmitted 79 from the remotely located processing center to one or more designated recipients.

When the fob 20 is collocated with the asset tracker device 40, in an emergency (911) situation, the apparatus 10 and methods 70 may be used to page for help, sending a users location and an SOS message to an emergency center. Emergency operators at the emergency center respond to the emergency message to notify response agencies such as search and rescue, local 911 operators, the Coast Guard or other government branch, or other emergency responder.

When the fob 20 is collocated with the asset tracker device 40, and in situations where a person wants to notify others that he or she is okay, a "SPOTCheck" function sends the location and an "OK" message to identified friends and family. The track mode may be used to let people know that you have arrived at a destination, or to save unlimited waypoints to a web page using Google™ Maps, for example. Also, the apparatus 10 and methods 70 may implement a "SPOTCast" function that broadcasts the user's location to the user's web page. Using Google™ Maps, for example, on the web page, allows others to access and watch the user's progress, for example.

Preferred embodiments of the systems 50 and methods 70 send the GPS coordinates of the asset tracker device 40 (an hence the asset 11) via satellite 52 to another location without relying on cellular systems. The systems and methods are user controlled. The user determines and controls who gets transmitted messages, and when and where they are sent. The web service, for example, allows the user to change preferences anytime.

In 911 situations, the systems 50 and methods 70 allow the user to send location coordinates to a emergency service center 56. The emergency service center 56 notifies emergency responders such as local 911, Coast Guard or other rescue services, so that help can be sent. This option may be used in life threatening or other critical emergencies. The user's location is determined by the GPS coordinates of the asset tracker device 40 and sent to the emergency service center 56.

Thus, systems, apparatus and methods for tracking or locating assets and providing emergency and non-emergency messaging for individuals have been disclosed. It is to be understood that the above-described embodiments are merely illustrative of some of the many specific embodiments that represent applications of the principles discussed above. Clearly, numerous other arrangements can be readily devised by those skilled in the art without departing from the scope of the invention.

What is claimed is:

1. Apparatus comprising:

user-carried apparatus having a unique ID, comprising:

a plurality of buttons that are each selectable to generate one Of a predetermined number of operational mode signals;

a short-range wireless transceiver; and a processor coupled to the plurality of selectable buttons and the short-range Wireless transceiver that is programmed to transmit a signal corresponding to the unique ID and selectively transmit a selected operational mode signal when a particular button is selected using a short-range wireless communication protocol; and asset tracking apparatus comprising:

a short-range wireless transceiver for receiving short-range wireless communication signals having the short-range wireless communication protocol;

a vibration sensor;

a global positioning system (GPS) receiver for processing GPS signals received from GPS satellites to generate a location signal indicative of the location of the asset tracking apparatus;

a simplex satellite transmitter for communicating with a remote location via one or more communication satellites; and a processor coupled to the short-range wireless receiver, the vibration sensor, the GPS receiver, and the satellite transmitter that is programmed to process the signal corresponding to the unique ID received from the user-carried apparatus to determine if the user-carried apparatus is in range and that the user-carried apparatus is authorized to communicate with the asset tracking apparatus, for transmitting the location signal to the remote location via the simplex satellite transmitter and the one or more communication satellites if the asset tracking apparatus moves and an authorized user-carried apparatus is out of range, and for transmitting the signal corresponding to the unique ID of the authorized user-carried apparatus and a selected operational mode signal received from the authorized user-carried apparatus if it is in range.

2. The apparatus recited in claim 1 wherein the processor in the asset tracking apparatus is programmed to transmit a signal to the remote location if the asset tracking apparatus moves to an unauthorized location.

3. The apparatus recited in claim 1 wherein the selectable buttons comprise an OK button, a help button and an emergency button.

4. The apparatus recited in claim 1 wherein the operational mode signals comprise one of a plurality of preprogrammed messages indicative of the status of a user of the user-carried apparatus.

5. An asset tracking system comprising:

a plurality of GPS satellites for generating GPS signals that are used to determine position;

one or more communication satellites for receiving and re-transmitting simplex signals;

one or more satellite gateways for receiving signals from the one or more communication satellites;

a remotely located processing center for receiving and processing the simplex signals and for creating and forwarding a corresponding message to one or more designated locations; and user-carried apparatus having a unique ID, comprising a plurality of buttons that are each selectable to generate one of a predetermined number of operational mode signals, a short-range wireless transceiver, and a processor for transmitting, using a short-range wireless communication protocol, a signal corresponding to the unique ID and a selected operational mode signal when a particular button is selected; and asset tracking apparatus disposed on an assert, comprising a short-range wireless transceiver for receiving short-range wireless communication signals having the short-range wireless communication protocol, a vibration sensor, a global positioning system (GPS) receiver for processing the GPS signals received from the GPS satellites to generate a location signal indicative of the location of the asset tracking apparatus, a simplex satellite transmitter for communicating with the remotely located processing center via the one or more communication satellites, and a processor for processing the signal corresponding to the unique ID received from the user-carried apparatus to determine if it is in range and that the user-carried apparatus is authorized to communicate with the asset tracking apparatus, for transmitting the location signal to the remotely located processing center via the simplex satellite transmitter and the one or more communication satellites if the asset tracking apparatus moves and an authorized user-carried apparatus is out of range, and for transmitting the signal corresponding to the unique ID and the selected operational mode signal received from the authorized user-carried apparatus if it is in range.

6. The system recited in claim 5 wherein the remotely located processing center forwards an email message to one or more email addresses.

7. The system recited in claim 5 wherein the remotely located processing center forwards a short message service (SMS) message to one or more selected cell phones.

8. The system recited in claim 5 wherein the remotely located processing center notifies a 911 emergency service with at least the location of the emergency.

9. The system recited in claim 5 wherein the selected operational mode signal is transmitted by way of one of the one or more communication satellites to multiple remote locations.

10. The system recited in claim 5 wherein the selected operational mode signal comprises one of a plurality of preprogrammed messages indicative of the status of a user of the user-carried apparatus.

11. An asset tracking method comprising:

providing user-carried apparatus having a unique ID and that comprises a plurality of buttons that are each selectable to generate one of a predetermined number of operational mode signals, a short-range wireless transceiver, and a processor;

disposing asset tracking apparatus on an assert, which asset tracking apparatus comprises a short-range wireless transceiver for receiving short-range wireless communication signals having a short-range wireless communication protocol, a global positioning system (GPS) receiver, a simplex satellite transmitter for communicating with a remotely located processing center via one or more communication satellites, and a processor;

receiving and processing GPS signals in the asset tracking apparatus to generate a location signal indicative of the location of the asset tracking apparatus;

determining if the asset tracking apparatus moves and authorized user-carried apparatus is out of range;

transmitting the location signal to the remotely located processing center via the simplex satellite transmitter and the one or more communication satellites if the asset tracking apparatus moves and authorized user-carried apparatus is out of range;

transmitting, using a short-range wireless communication protocol, a signal corresponding to the unique ID of authorized user-carried apparatus and a selected operational mode signal when a particular button is selected from the user-carried apparatus to the asset tracking apparatus;

processing the signal corresponding to the unique ID in the asset tracking apparatus to determine if the user-carried apparatus is in range and if the user-carried apparatus is authorized to communicate with the asset tracking apparatus;

transmitting the signal corresponding to the unique ID and a selected operational mode signal received from an in-range authorized user-carried apparatus to the remotely located processing center via the simplex satellite transmitter and the one or more communication satellites; and processing and retransmitting the location signal of the asset tracking apparatus and a message corresponding to the selected operational mode signal from the remotely located processing center to one or more designated recipients.

12. The method recited in claim 11 wherein the remotely located processing center forwards an email message to one or more email addresses.

13. The method recited in claim 11 wherein the remotely located processing center forwards a short message service (SMS) message to one or more selected cell phones.

14. The method recited in claim 11 wherein the remotely located processing center forwards a short message service (SMS) message to a 911 emergency service.

15. The method recited in claim 11 wherein the location signal and the message are transmitted by way of one of the one or more communication satellites to multiple remote locations.

16. The method recited in claim 11 wherein the location signal and the message are transmitted by way of the one or more communication satellites to multiple remote locations.

17. The method recited in claim 11 wherein the message comprises one of a plurality of preprogrammed messages indicative of the status of a user.

* * * * *